US005217293A

United States Patent [19]

Kobzeff

[11] Patent Number: 5,217,293

[45] Date of Patent: Jun. 8, 1993

[54] LIGHT BOX TRANSPARENT DRAWING BOARD

[76] Inventor: Pete Kobzeff, 601 N. Ridgeway La. #H, La Habra, Calif. 90631

[21] Appl. No.: 927,743

[22] Filed: Aug. 10, 1992

[51] Int. Cl.[5] ..... G09F 13/04

[52] U.S. Cl. ..... 362/97; 362/33; 362/277

[58] Field of Search ..... 40/564, 574, 578, 361, 40/367; 362/33, 97, 98, 277, 282, 220, 364, 366

[56] References Cited

U.S. PATENT DOCUMENTS

| | | | |
|---|---|---|---|
| 1,163,647 | 12/1915 | Dick | 362/97 |
| 1,756,289 | 4/1930 | Harding | 362/97 |
| 2,257,005 | 9/1941 | Grasse | 362/97 |
| 2,328,471 | 8/1943 | Leffel | 362/97 |
| 2,701,838 | 2/1955 | Loesch | 362/97 |
| 2,877,556 | 3/1959 | Hulen | 362/97 |
| 3,019,331 | 1/1962 | Geist | 362/97 |
| 3,850,523 | 11/1974 | Skavnak | 362/97 |
| 4,426,798 | 1/1984 | Saunders et al. | 40/367 |
| 4,564,886 | 1/1986 | Morcheles | 362/97 |
| 4,985,602 | 1/1991 | Kouhia | 362/97 |

*Primary Examiner*—Ira S. Lazarus
*Assistant Examiner*—Alan B. Cariaso
*Attorney, Agent, or Firm*—Edgar W. Averill, Jr.

[57] ABSTRACT

A transparent drawing board and supporting light box combination. The light box has a housing with a source of light and a translucent light diffuser positioned on an angle with respect to the base of the drawing board. A rectangular, transparent drawing board has four soft support strips which fit within a peripheral wall formed about the sides of the translucent light diffuser. This permits the transparent drawing board to be securely held on the angled top of the light box and also permits the transparent board to be lifted, turned, and again supported on the upper edge of the peripheral wall. The transparent drawing board extends past the four soft support strips so that it may be easily lifted from the light box.

6 Claims, 4 Drawing Sheets

LIGHT BOX TRANSPARENT DRAWING BOARD

BACKGROUND OF THE INVENTION

The field of the invention is artists, supplies, and the invention relates more particularly to electric light boxes. For the illustrator, designer, graphic artist, photo retoucher, hobbyist, it is most useful to have a light box to permit one to trace or otherwise create graphic work. Typical light boxes have a flat, horizontal surface. An angled surface facilitates the use of the light box for most uses. Various light boxes having angled surfaces are shown in the following U.S. Pat. Nos. 1,756,289; 2,257,005; 2,328,471; 3,019,331; 4,426,798; 4,564,886; and 4,985,602.

The combination of a transparent drawing board with a light box with an angled top would provide an ideal combination. Typical drawing boards are not securely held on an angled surface and thus it is most common to use a light box with a flat or horizontal surface when a drawing board is used on its upper surface.

SUMMARY OF THE INVENTION

It is an object of the present invention to provide a light box with an angled top and a transparent drawing board combination which permits the drawing board to be comfortably held on the angled top of a light box and yet easily transported or turned to another angle while still being supported on the angled top of the light box.

The present invention is for a transparent drawing board and supporting light box combination. The light box has a housing with a base, side walls, an interior volume including a source of light, and an angled, upper peripheral edge securing a translucent light diffuser, and the upper peripheral edge extends past the translucent light diffuser to form a peripheral wall. The peripheral wall has an upper edge. A rectangular, transparent drawing board has four soft support strips affixed to the lower surface thereof inwardly from the edges. This set of four soft support strips fits within the peripheral wall of the light box to be securely held at a comfortable drawing angle and yet easily removed from the light box. Preferably, the four soft strips are fabricated from rubber, and the top of the light box is at an angle of about 30 degrees from the horizontal.

DESCRIPTION OF THE PREFERRED EMBODIMENTS

Figure 1:
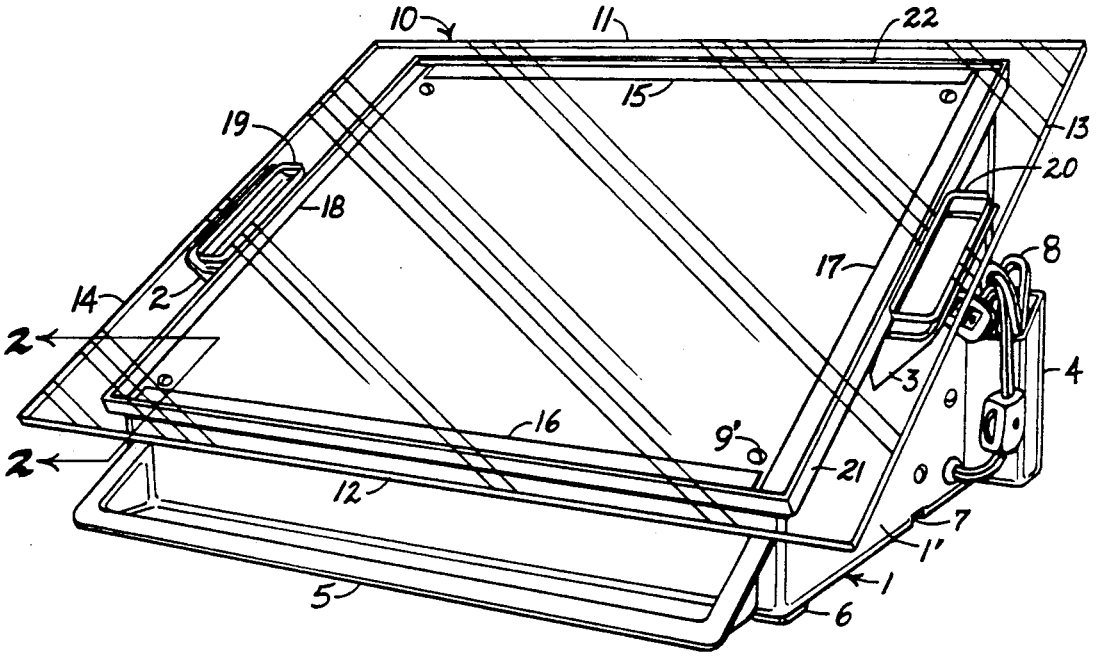
FIG. 1 is a perspective view showing the top, front and right side of the light box and transparent drawing board combination of the present invention.

The light box and drawing board combination of the present invention is shown in perspective view in FIG. 1 where the light box is indicated by reference character 1, and the drawing board by reference character 10. Light box 1 has a light-weight, plastic housing 1' which is vacuum formed or otherwise fabricated from a thermoplastic material which is both light in weight but sufficiently strong to support a drawing board and the arms of an artist using the same. Light box 1 has a left handle 2, a right handle 3 and a storage box 4 to hold an electrical cord 8. The utility tray 5 is formed along the front of the light box, and four rubber feet 6 help prevent the light box from sliding on its support surface. A support channel 7 is formed in the base which helps to hold the light assembly as shown best in FIG. 10 of the drawings.

A light diffuser 9 is secured by four screws 9' to the housing and is maintained at an angle of about 30 degrees with respect to the base of the light box. The light diffuser is, of course, fabricated from a translucent plastic and functions to diffuse the light emanating from within the box.

The transparent drawing board 10 has a top edge 11, a bottom edge 12, a right edge 13 and a left edge 14. Four rubber strips comprising a top strip 15, a bottom strip 16, a right side strip 17 and a left side strip 18 are glued, or otherwise adhered, to the bottom surface of drawing board 10. These rubber strips are placed inwardly from edges 11, 12, 13 and 14 and, preferably, left and right handle holds 19 and 20 are formed exteriorly of the rubber strips. In this way, the transparent drawing board can be easily removed from the upper surface of the light box.

Figure 2:
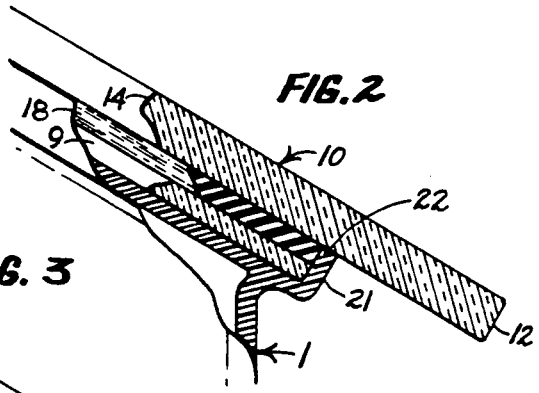
FIG. 2 is an enlarged cross-sectional view taken along line 2—2 of FIG. 1.
Figure 3:
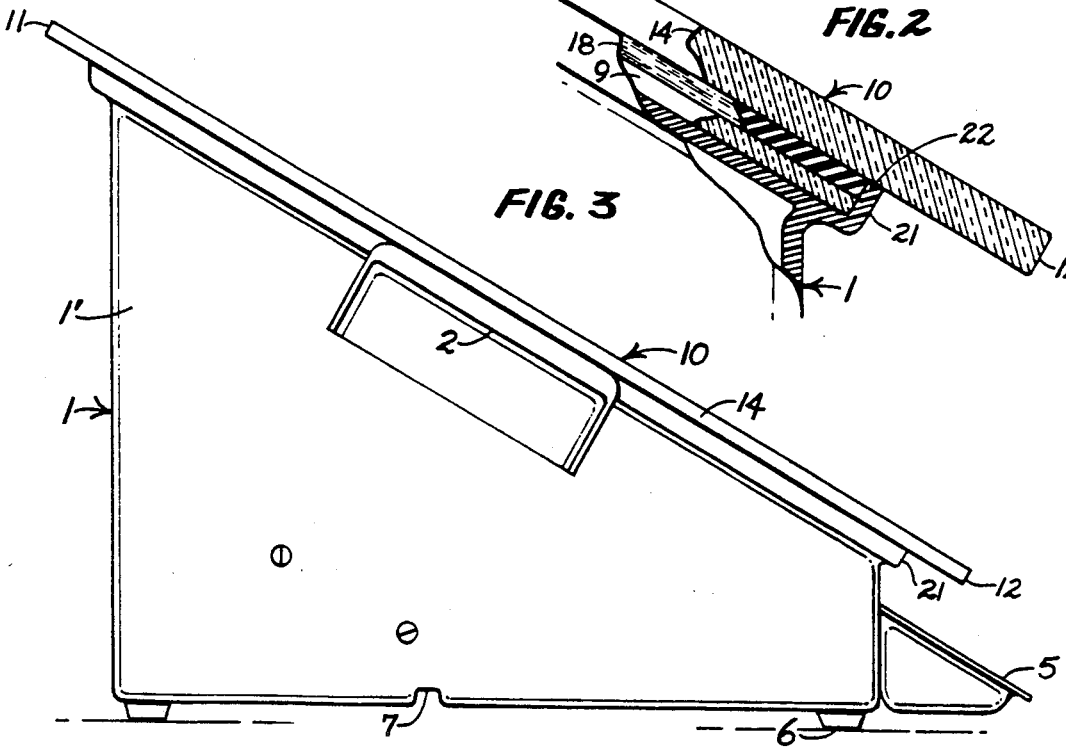
FIG. 3 is a left side view.

The transparent drawing board 10 is securely held on the angled top of light box 1 by the contact of the four rubber strips 15, 16, 17 and 18 with a peripheral wall 21 which extends upwardly from light diffuser 9 as shown best in FIG. 2 of the drawings. Peripheral wall 21 has a top edge 22, and this top edge is used to support the drawing board when it is lifted and turned as shown best in FIGS. 4 and 7 of the drawings.

Figure 4:
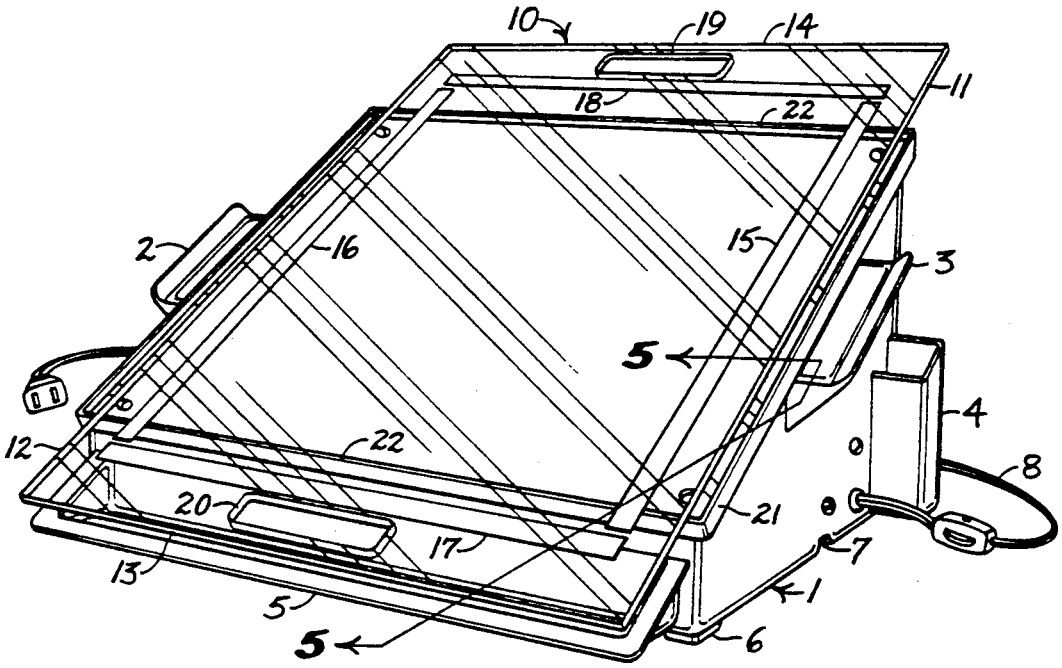
FIG. 4 is a perspective view analogous to FIG. 1 but with the transparent drawing board rotated 90 degrees.

As shown in FIG. 4, drawing board 10 has been lifted and turned 90 degrees, and the bottom and top rubber strips 16 and 15 rest on the upper edge 22 of peripheral wall 21.

Figure 5:
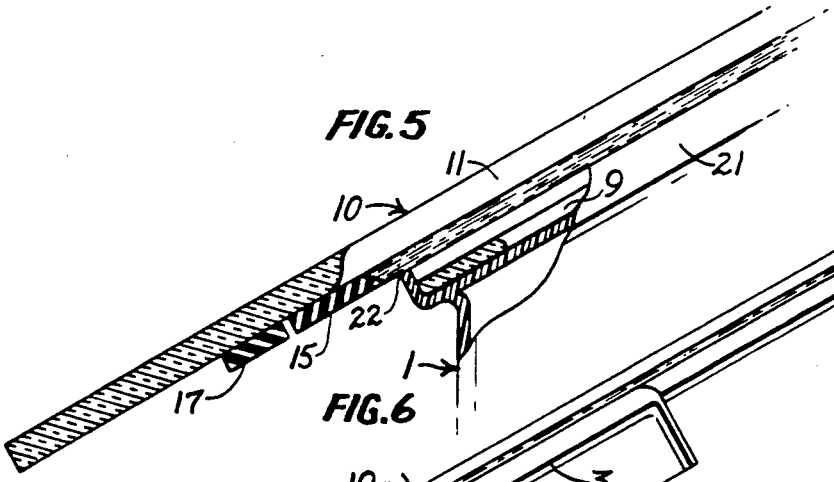
FIG. 5 is a cross-sectional view taken along line 5—5 of FIG. 4.
Figure 6:
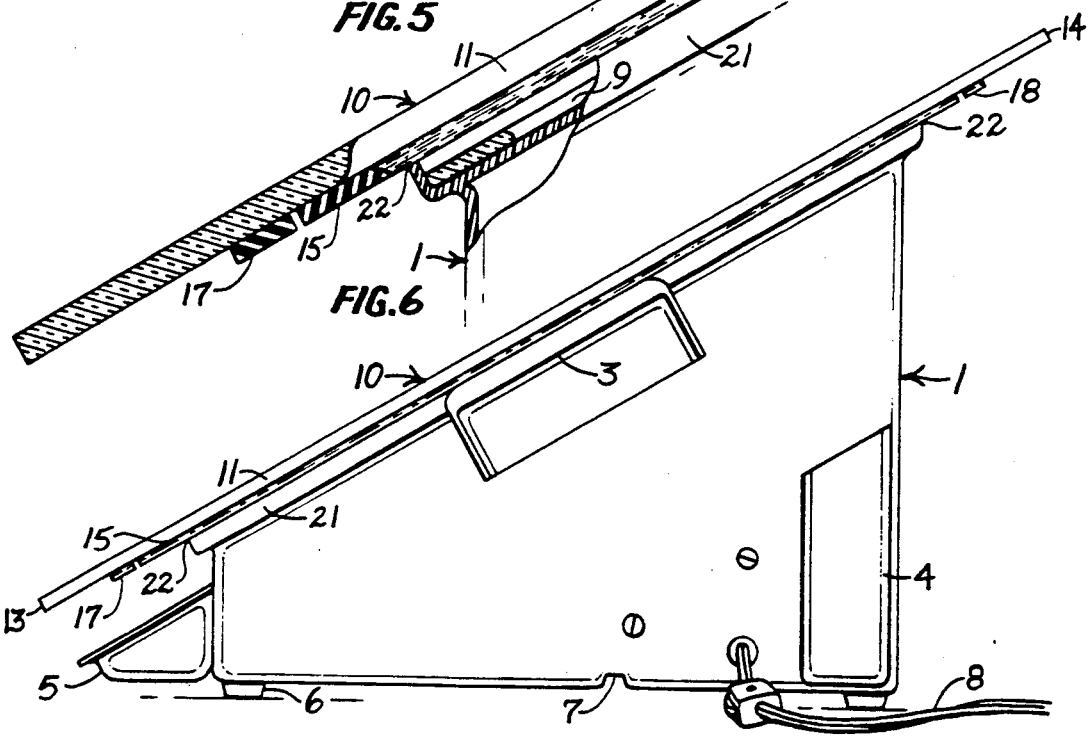
FIG. 6 is a right side view of the light box and transparent drawing board of FIG. 4.

This support is also shown in cross-sectional view in FIG. 5, and because of the softness of the rubber strips 15 and 16, the drawing board 10 will not slide down the angled surface of the light box. This support is also shown in side view in FIG. 6.

Figure 7:
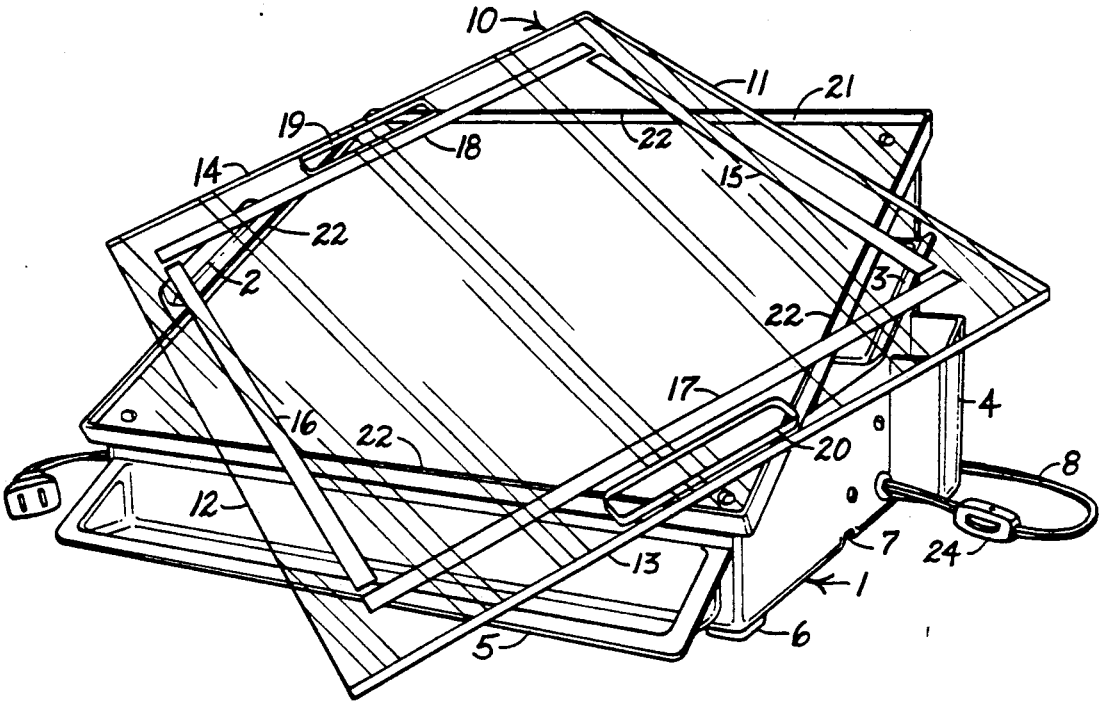
FIG. 7 is a perspective view analogous to FIG. 1 but with the transparent drawing board rotated at an angle of about 30 degrees with respect to the light box.

As shown in FIG. 7, the drawing board can also be turned at an angle such as about 30 degrees where the upper edge 22 of peripheral wall 21 supports all four rubber strips 15, 16, 17 and 18 to provide a secure positioning of the board to permit the artist to utilize the board at its most comfortable angle. The board can be supported at any angle with respect to the light box.

Figure 8:
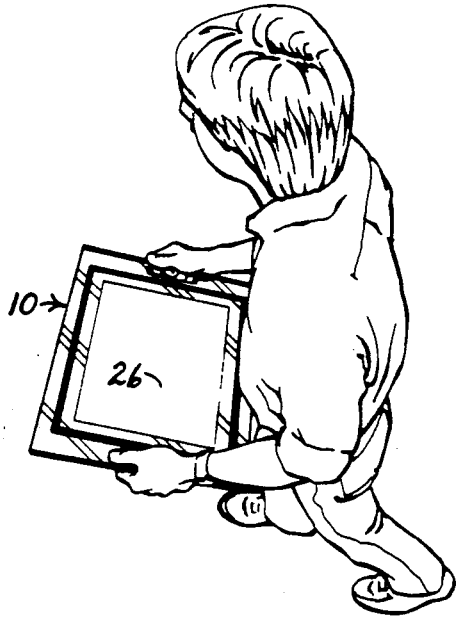
FIG. 8 is a perspective view of an artist transporting the transparent drawing board of FIG. 1.

It is also easy to lift and carry the board as indicated in FIG. 8 where art work 26 is shown held to the upper surface of drawing board 10.

Figure 9:
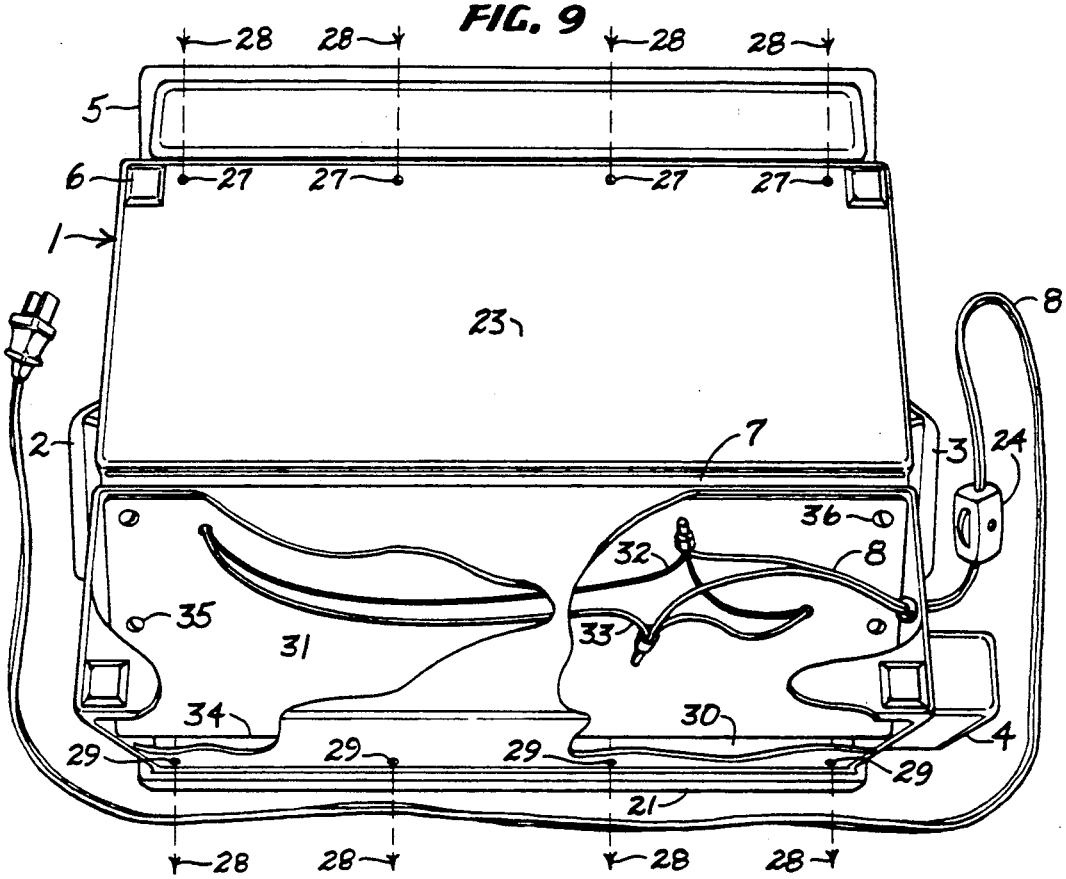
FIG. 9 is a bottom perspective view partially cut away showing the bottom and rear of the light box of FIG. 1.
Figure 10:
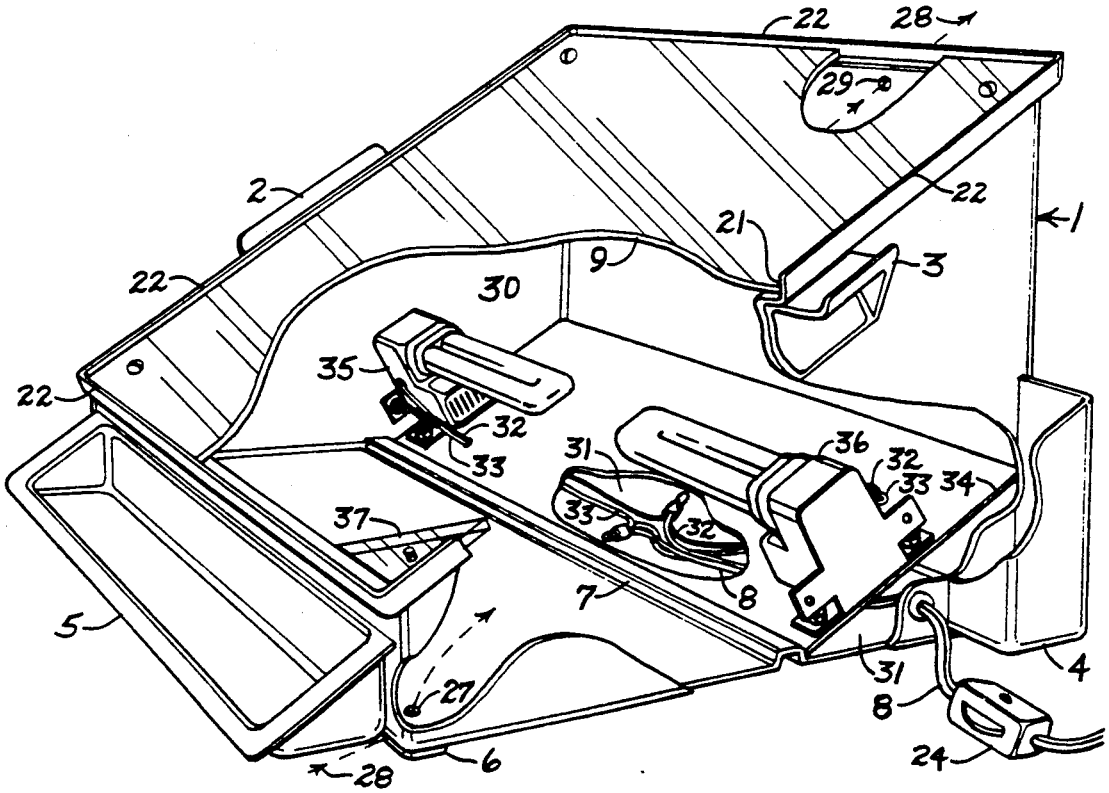
FIG. 10 is a perspective view, partially cut away showing the top, front and right side of the light box of FIG. 1 and also showing the interior construction thereof.

The inner construction of the light box is shown in FIGS. 9 and 10 where it can be seen that a series of intake air vent holes 27 are formed in bottom 23 which permit air to flow as indicated by arrows 28 upwardly through intake air vent holes 27 and out outlet air vent holes 29 as indicated by arrows 28.

As shown in FIGS. 9 and 10, the inner compartment space is indicated by reference character 30 and contains an enclosed wiring compartment 31 below mounting plate 34. A positive conductor 32 and a negative conductor 33 are affixed to the two conductors of electrical cord 8 and, in turn, are connected to light fixtures 35 and 36 in a conventional manner. Light fixtures 35 and 36 are fluorescent fixtures which have U-shaped bulbs which provide substantial light with a minimum of heat so that the interior of the light box can be easily maintained at a cool temperature by the vent holes 27 and 29. The light is turned on and off by switch 24.

While typical light boxes are fabricated from metal and use heavyweight fluorescent lamp ballasts, the light box of the present invention is fabricated from lightweight plastic and has lightweight light fixtures. The result is a light box which may be easily moved and yet is compact. Also, most light boxes have a horizontal surface which is uncomfortable for the user. The light box and transparent drawing board of the present invention permits the artist to affix work to the upper surface of the drawing board over which the drawing sheet may be secured. The board then can be lifted and rotated a complete 360 degrees to permit the artist to work on the drawing at any comfortable angle.

While the strips 15, 16, 17 and 18 have been described as rubber strips, they can, of course, be fabricated from any appropriate soft material such as foamed plastic or felt. The transparent drawing board is preferably acrylic plastic, and the strips hold the edges of the transparent board above a surface so it can always be easily picked up.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A transparent drawing board and supporting light box combination comprising:

a light box main housing having a base, side walls, an interior volume including a source of light, an angled, upper peripheral edge securing a translucent light diffuser which is also angled, said upper peripheral edge extending upwardly past said translucent light diffuser to form a peripheral wall, said peripheral wall having an upper edge;

a rectangular, transparent drawing board having an upper surface, a lower surface, a bottom edge, a right side edge, a left side edge, and a top edge; and four soft support strips affixed to the lower surface of said transparent drawing board near the bottom, right, left and top edges, each support strip having an outer edge, and the outer edges being positioned to fit within said peripheral wall of said light box so that the transparent drawing board can be securely held on the angled, translucent light diffuser and yet the transparent drawing board can also be lifted and turned and still be held on the upper edge of the peripheral wall.

2. The transparent drawing board and supporting light box combination of claim 1 wherein said outer edge of each of said four soft support strips closely fits within said peripheral wall.

3. The transparent drawing board and supporting light box combination of claim 1 wherein said four soft support strips are elongated rectangular strips.

4. The transparent drawing board and supporting light box combination of claim 3 wherein the strips about abut one another to form an essentially continuous, rectangular strip so that the transparent drawing board can be lifted and placed on the upper edge of said peripheral wall to form a solid support for the transparent drawing board.

5. The transparent drawing board and supporting light box combination of claim 1 wherein said transparent drawing board has a handle opening near the right and left edges thereof.

6. The transparent drawing board and supporting light box combination of claim 1 wherein the translucent light diffuser is supported at an angle of about 30 degrees with respect to the base.

* * * * *